United States Patent [19]

Koizumi et al.

[11] 4,286,189

[45] Aug. 25, 1981

[54] COLOR CATHODE RAY TUBE WITH SHADOW MASK HAVING INWARDLY BENT SKIRT PORTIONS

[75] Inventors: Sachio Koizumi; Akio Yamaguchi, both of Mobara, Japan

[73] Assignee: Hitachi, Ltd., Tokyo, Japan

[21] Appl. No.: 122,993

[22] Filed: Feb. 20, 1980

Related U.S. Application Data

[63] Continuation of Ser. No. 911,394, Jun. 1, 1978, abandoned.

[30] Foreign Application Priority Data

Nov. 4, 1977 [JP] Japan ..... 52-131554

[51] Int. Cl.[3] ..... H01J 29/07

[52] U.S. Cl. ..... 313/402; 313/407

[58] Field of Search ..... 313/407, 406, 405, 404, 313/402

[56] References Cited

U.S. PATENT DOCUMENTS

| | | | |
|---|---|---|---|
| 3,358,170 | 12/1967 | Fiore | 313/406 |
| 3,737,703 | 6/1973 | Tsuneta et al. | 313/407 |
| 3,885,190 | 5/1975 | Taniguchi et al. | 313/402 |
| 4,136,300 | 1/1979 | Morrell | 313/403 |

*Primary Examiner*—Palmer C. Demeo

*Attorney, Agent, or Firm*—Craig and Antonelli

[57] ABSTRACT

A color cathode ray tube wherein spring-back of a skirt of a shadow mask which causes the distortion of apertures of the shadow mask is prevented. The shadow mask is formed to exhibit a radius of curvature on an opposing pair of edges thereof. The shadow mask may be formed to exhibit a radius of curvature on four opposing edges. The radius of curvature is substantially equal to a radius of curvature of an apertured area of the shadow mask.

5 Claims, 16 Drawing Figures

COLOR CATHODE RAY TUBE WITH SHADOW MASK HAVING INWARDLY BENT SKIRT PORTIONS

Figure 1:
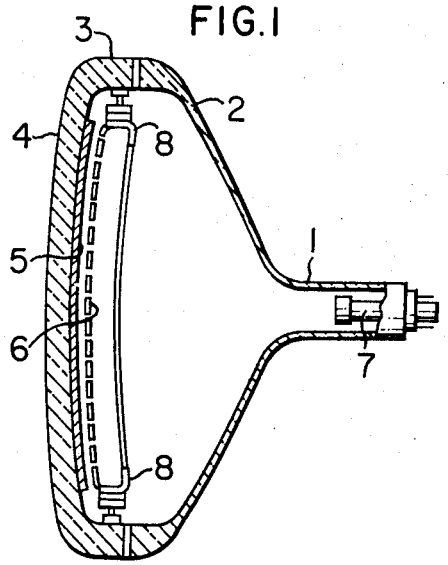

This is a continuation of application Ser. No. 911,394, filed June 1, 1978, and now abandoned.

The present invention relates to a color cathode ray tube, and more particularly to a structure of a shadow mask of a shadow mask type color cathode ray tube.

Figure 2A:
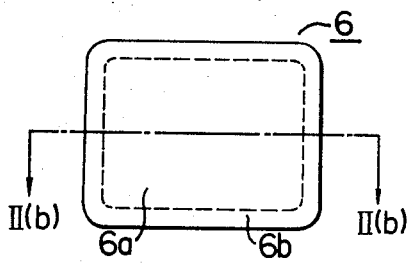
FIG.2(a) PRIOR ART
Figure 2B:
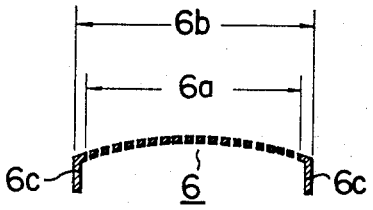
FIG.2(b) PRIOR ART
Figure 2C:
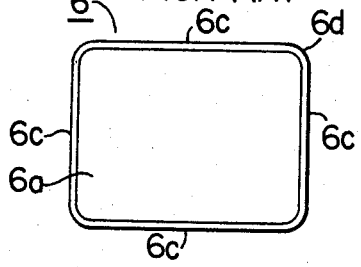
FIG.2(c) PRIOR ART
Figure 3A:
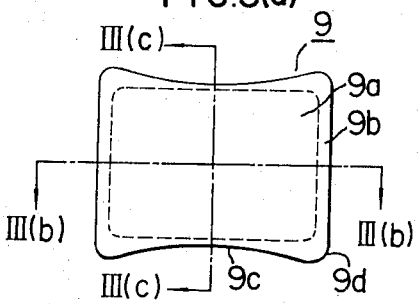
Figure 3B:
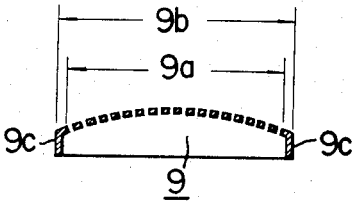
Figure 3D:
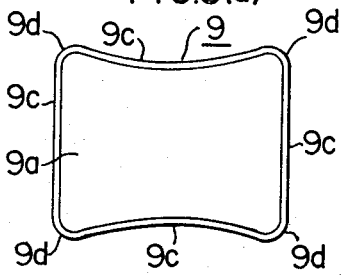
Figure 3C:
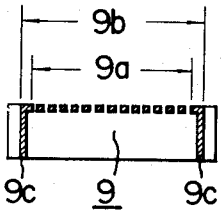
Figure 4A:
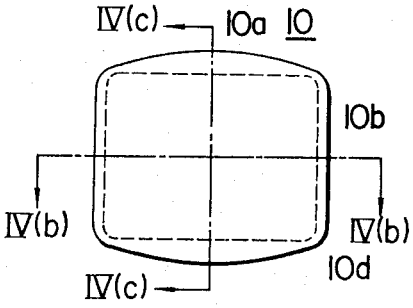
Figure 4B:
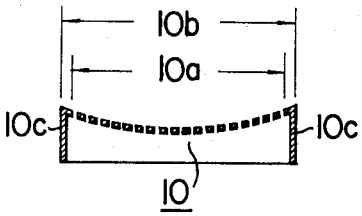
Figure 4D:
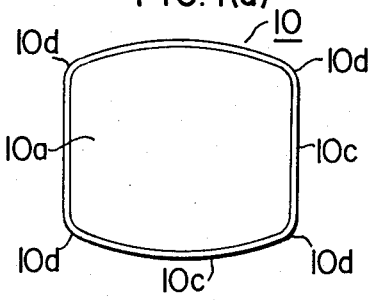
Figure 4C:
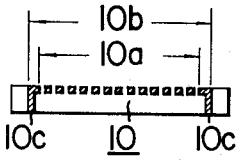
Figure 5A:
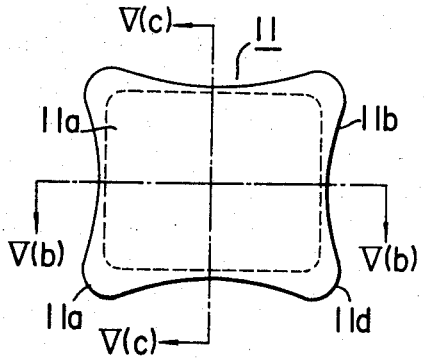
Figure 5B:
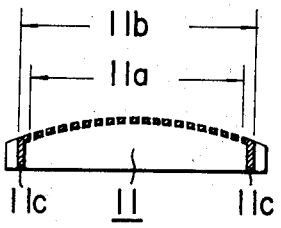
Figure 5D:
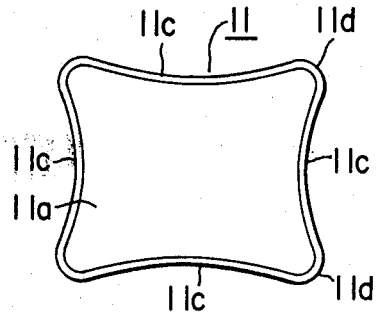
Figure 5C:
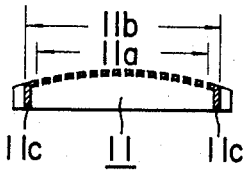

In the drawings:

FIG. 1 shows a fragmentary sectional view illustrating an example of the shadow mask type color cathode ray tube;

FIGS. 2(*a*), 2(*b*), and 2(*c*) show a fragmentary front view, a sectional view thereof taken along a line II(*b*)—II(*b*) of FIG. 2(*a*) and a fragmentary rear view, respectively, of an example of a prior art shadow mask type color cathode ray tube;

FIGS. 3(*a*), 3(*b*), 3(*c*) and 3(*d*) show a fragmentary front view, a sectional view thereof taken along a line III(*b*)—III(*b*) of FIG. 3(*a*), a sectional view thereof taken along a line III(*c*)—III(*c*) of FIG. 3(*a*) and a fragmentary rear view, respectively, of one embodiment of a shadow mask of a color cathode ray tube in accordance with the present invention;

FIGS. 4(*a*), 4(*b*), 4(*c*) and 4(*d*) show a fragmentary front view, a sectional view thereof taken along line IV(*b*)—IV(*b*) of FIG. 4(*a*), a sectional view thereof taken along a line IV(*c*)—IV(*c*) of FIG. 4(*a*) and a fragmentary rear view, respectively, of another embodiment of the shadow mask of the color cathode ray tube in accordance with the present invention; and FIGS. 5(*a*), 5(*b*), 5(*c*) and 5(*d*) show a fragmentary front view, a sectional view thereof taken along a line V(*b*)—V(*b*) of FIG. 5(*a*), a sectional view thereof taken along a line V(*c*)—V(*c*) of FIG. 5(*a*) and a fragmentary rear view, respectively, of a further embodiment of the shadow mask of the color cathode ray tube in accordance with the present invention.

Referring to FIG. 1, a color cathode ray tube generally comprises a neck 1, a funnel 2, a panel 3 disposed at an open end of the funnel 2, a fluorescent plane 5 coated on an inner surface of a face plate 4 of the panel 3, a shadow mask 6 spaced from the fluorescent plane 5 by a given distance, and an electron gun 7 housed in the neck 1. The shadow mask 6 is constructed as shown in FIGS. 2(*a*), 2(*b*) and 2(*c*). In FIGS. 2(*a*), 2(*b*) and 2(*c*), the shadow mask 6 comprises an apertured portion 6*a* having a number of slot apertures through which an electron beam passes, an effective area 6*b* including the apertured portion 6*a* and extending spherically in a forward direction to face the fluorescent plane 5, a skirt 6*c* for presenting a mechanical strength to the effective area 6*b* of the shadow mask, and corners 6*d*.

The shadow mask of the color cathode ray tube of the construction described above is generally manufactured by sequentially exposing a cold drawn rolled steel plate for the shadow mask having a thickness of 0.10 to 0.2 mm, in a predetermined pattern, developing the plate, removing photoresist at exposed areas and etching the plate to form a number of apertures through which an electron beam is to be passed. Then, there follow the steps of cutting the plate into individual shadow masks, annealing the plate to remove internal stress, subjecting the plate to work hardening by a leveling process to allow the plate to withstand the next pressing process, and pressing the plate to present a predetermined curved surface of the shadow mask. The shadow mask 6 thus formed has its skirt 6*c* welded and fixed to a support frame 8 (see FIG. 1), which is provided with a plurality of springs, not shown, which, together with pins on the inner surface of the panel 3, fix the shadow mask 6 in position relative to the fluorescent plane 5 on the inner surface of the panel 3.

In the shadow mask 6 of the color cathode ray tube of the construction described above, the effective area 6*b* is formed by an expansion forming while the skirt 6*c* and the corners 6*d* are formed by a contraction forming. However, the skirt 6*c* formed by the contraction forming is apt to spring back to deform the shape of the apertures of the apertured portion 6*a* relative to the shape of the effective area 6*b*. Furthermore, since the skirt 6*c* is very weak in rigidity, it must be usually welded and fixed to the support frame 8 to integrally mount it.

It is an object of the present invention to avoid the above drawbacks and provide a color cathode ray tube having a shadow mask which prevents the influence of the spring-back of the skirt to the effective area.

In order to attain the above object, the color cathode ray tube of the present invention has a modified shape shadow mask. The color cathode ray tube of the present invention will now be described in detail with reference to the drawings.

In FIGS. 3(*a*), 3(*b*), 3(*c*) and 3(*d*), numeral 9 denotes the shadow mask which is formed with a plurality of slot apertures at an apertured portion 9*a*, like the apertured portion 6*a* of the prior art shadow mask. The shadow mask 9 has a curved surface effective area 9*b* defined by a pair of opposing longer sides with the curved surface extending toward the screen. Those portions of a skirt 9*c* which are the longer sides of the shadow mask 9 have substantially the same radius of curvature as that of the expanded shape of the effective area 9*b* and are bent in opposite direction to the direction of expansion of the effective area 9*b*. That is, these portions of the skirts 9*c* are formed to present convex curved surfaces relative to the effective area 9*b*, i.e., the shape of expansion of the effective area 9*b* in the direction of the longer side is arcuate as shown in the sectional view of FIG. 3(*b*). Those portions of the skirt 9*c* which are the shorter sides of the shadow mask 9 are bent at substantially right angles to the effective area 9*b* so that the effective area 9*b* is substantially flat in the direction parallel to the shorter sides, as shown in the III(c)—III(c) sectional view of FIG. 3(*c*).

In the shadow mask of the color cathode ray tube thus constructed, since the radius of curvature of the expansion of the effective area 9*b* is substantially the same as the radius of curvature of the skirt 9*c* relative to the effective area 9*b*, the skirt 9*c* is completely free from the effects of contraction and expansion due to the press forming except at the corners 9*d*, or even if it is affected, the degree thereof is so small that it does not raise a problem in subsequent steps. Thus, the spring-back at the skirt 9*c*, which occurred in the prior art cathode ray tube, is completely eliminated. Furthermore, since the curved surface of the skirt 9*c* and the curved surface of the effective area 9*b* mutually define the shapes thereof, the skirt 9*c* shows a very high rigidity. Even if the radius of curvature of the skirt 9*c* differs from the radius of curvature of the effective area 9*b*, the spring-back can be reduced and the rigidity can be increased by presenting the radius of curvature to the skirt 9*c* relative to the effective area 9*b*. In FIGS. 4(*a*), 4(*b*), 4(*c*) and 4(*d*), numeral 10 denotes the shadow mask which is formed with a number of slot apertures at an apertured portion 10*a* thereof. An effective area 10*b* of the shadown mask 10 defined by a pair of opposing longer sides is formed into a curved plane which expands toward the screen. Those portions of a skirt 10*c* which are the longer sides of the shadow mask 10 have substantially the same radius of curvature as that of the expanded effective area 10*b* and are bent in the same direction as the direction of expansion of the effective area 10*b*. That is, the portions of the skirt 10*c* are formed to present concave curved surfaces relative to the effective area 10*b*, i.e., the shape of expansion of the effective area 10*b* in the direction of the longer sides is arcuate as shown in the sectional view of FIG. 4(*b*). Those portions of the skirt 10*c* which are the shorter sides of the shadow mask 10 are bent at substantially right angle to the effective area 10*b* so that the effective area 10*b* is substantially flat in the direction parallel to the shorter sides, as shown in the IV(c)—IV(c) sectional view of FIG. 4(*c*).

In the shadow mask of the color cathode ray tube thus constructed, since the radius of curvature of the effective area 10*b* is substantially the same as the radius of curvature of the skirt 10*c* relative to the effective area 10*b*, the skirt 10*c* is completely free from the effects of contraction and expansion due to the press forming, or even if it is affected, the degree thereof is so small that it does not raise a problem in subsequent steps. Thus, the spring-back at the skirt10*c* is completely avoided, as in the previous embodiment. Even if the radius of curvature of the effective area 10*b* and the skirt 10*c* differs from each other, a similar effect can be achieved.

In FIGS. 5(*a*), 5(*b*), 5(*c*) and 5(*d*), numeral 11 denotes the shadow mask which is formed with a number of slot apertures at an apertured portion 11*a* thereof. An effective area 11*b* of the shadow mask 11 defined by a pair of opposing longer sides an a pair of opposing shorter sides is formed into a curved plane which expands toward a screen. A skirt 11*c* which occupies the longer and shorter sides of the shadow mask 11 has substantially the same radius of curvature as that of the expanded effective area 11*b* and is bent in the opposite direction to the direction of the expansion of the effective area 11*b*. That is, the skirt 11*c* which corresponds to the longer and shorter sides is formed to present a convex spherical surface relative to the effective area 11*b*. The shadow mask thus constructed attains the same effects as those in the previous embodiments.

While the shadow mask has been shown to have slot apertures in the embodiments described above, the present invention is not limited to those shapes but the same effect is obtained in a shadow mask having circular apertures.

Furthermore, while the curved surface has been shown to be arcuate in the illustrated embodiments, the present invention is not limited to the specific curve but the same effect is obtained by a parabolic curved surface, a cycloid curved surface or a line segment surface.

As described hereinabove, the shadow mask of the color cathode ray tube of the present invention is very stable and shows a high rigidity as compared with the shadow mask having the skirt of conventional shape. Furthermore, since the influence to the apertured portion of the shadow mask during the forming thereof is reduced, there is caused in the aperture portion of the resulting shadow mask, no wrinkle nor irregularity of the aperture arrangements which is attributed to the stretcher strain phenomenon. Moreover, since a sufficient strength is maintained without the support frame for enhancing the strength of the shadow mask, manufacturing costs can be saved by the elimination of the support frame.

What we claim is:

1. A shadow mask type color cathode ray tube comprising:

an electron gun;

a fluorescent plane provided on an inner surface of a face plate of said cathode ray tube, said fluorescent plane forming a screen; and an apertured shadow mask for defining points of bombardment of an electron beam on said fluorescent plane, said shadow mask being provided with a skirt portion at its periphery to give a mechanical strength to said shadow mask, wherein said shadow mask has an effective area having a predetermined radius of curvature and being convexly curved toward said fluorescent plane;

a pair of opposing sides of said skirt portion being bent in a direction toward an axis extending between the center of the effective area of said shadow mask and the electron gun with the radius of curvature thereof being substantially the same as that of the effective area of said shadow mask.

2. A shadow mask type color cathode ray tube according to claim 1, wherein the effective area of the shadow mask is convexly curved in relation to the skirt portion.

3. A shadow mask type color cathode ray tube according to claim 1, wherein two pairs of opposing portions of said skirt are bent in a direction toward an axis extending between the center of the effective area of said shadow mask and the electron gun with the radius of curvature thereof being substantially the same as that of the effective area of said shadow mask, said two pairs of opposing portions of said skirt being closest to each other at the centers thereof.

4. A shadow mask color cathode ray tube comprising:

an electron gun a fluorescent plane provided on an inner surface of a face plate of said cathode ray tube, said fluorescent plane forming a screen; and an apertured shadow mask for defining points of bombardment of an electron beam on said fluorescent plane, said shadow mask being provided with a skirt portion at its periphery to give a mechanical strength to said shadow mask, wherein said shadow mask has an effective area having a predetermined radius of curvature;

at least two opposing sides of said skirt portion being bent in a direction toward an axis extending between the center of the effective area of said shadow mask and the electron gun with the radius of curvature thereof being substantially the same as that of the effective area of said shadow mask.

5. A shadow mask type color cathode ray tube according to claim 1 or 4, wherein said curved surfaces of said opposing portions of said skirt are closest to each other at the center of said effective area of said shadow mask.

* * * * *